United States Patent [19]

Schauer

[11] 3,970,057

[45] July 20, 1976

[54] INTERNAL COMBUSTION ENGINE

[76] Inventor: George A. Schauer, 2023 Kellogg Ave., Ames, Iowa 50010

[22] Filed: June 14, 1973

[21] Appl. No.: 370,165

[52] U.S. Cl. ..... 123/51 BA; 123/51 BD; 123/53 BA

[51] Int. Cl.[2] ..... F02B 25/08; F02B 75/28

[58] Field of Search ..... 123/65 A, 53 BA, 51 BA, 123/51 BD, 53 B

[56] References Cited

UNITED STATES PATENTS

| | | | |
|---|---|---|---|
| 1,149,142 | 8/1915 | Hornor | 123/53 B |
| 1,476,309 | 12/1923 | Toth | 123/53 BA |
| 1,614,867 | 1/1927 | Bronander | 123/53 BA |
| 1,812,379 | 6/1931 | Spencer | 123/65 A |
| 2,311,311 | 2/1943 | Lacy | 123/51 BA |
| 2,320,648 | 6/1943 | Plumb | 123/53 BA |
| 2,724,372 | 11/1955 | Schowalter | 123/65 A |
| 2,748,757 | 6/1956 | Morris | 123/51 BA X |
| 2,768,616 | 10/1956 | Venediger | 123/51 BD |
| 2,875,738 | 3/1959 | Scherber | 123/51 BD |
| 2,985,157 | 5/1961 | Venediger | 123/51 BA |
| 3,117,566 | 1/1964 | Venediger | 123/51 BA |
| 3,411,289 | 11/1968 | Antonsen et al. | 123/51 BA X |
| R15,984 | 1/1925 | Knudsen | 123/53 BA |

*Primary Examiner*—Charles J. Myhre
*Assistant Examiner*—Tony M. Argenbright
*Attorney, Agent, or Firm*—Zarley, McKee, Thomte & Voorhees

[57] ABSTRACT

An internal combustion engine comprises a housing having two cylinders formed therein, a combustion chamber between the two cylinders, and two crankcases. The cylinders are angularly disposed with respect to one another in a V shape with the combustion chamber being located at the apex of the V-shaped configuration. The crankcases are located at the opposite ends of the V-shaped configuration. Pistons are slidably mounted within each of the cylinders for reciprocating movement toward and away from the combustion chambers. The pistons are operatively connected to the crankshafts. One of the cylinders has inlet ports and the other cylinder has exhaust ports and inlet ports therein. During the scavenging portion of the cycle, the exhaust ports and the inlet ports are all opened. The two sets of inlet ports serve to scavenge the previously burned gases from the combustion chamber and also serve to charge the cylinder for the next cycle. Fuel can be admitted through both sets of inlet ports or through either set for gasoline operation. When fuel is admitted only through the inlet ports farthest from the exhaust ports, loss of fuel out the exhaust ports would be substantially reduced during scavenging. Fuel discharge out the exhaust ports would not be prevalent for diesel units.

4 Claims, 10 Drawing Figures

INTERNAL COMBUSTION ENGINE

BACKGROUND OF THE INVENTION

This invention relates generally to internal combustion engines and particularly to two-cycle internal combustion engines.

Two-cycle engines such as those used for outboard boat motors, lawn mowers, snowmobiles, and some trucks, are very inefficient in their use of fuel. The primary reason for this is that a great portion of the fuel is never burned, but is instead discharged with the exhaust. This results in pollution and wasted fuel.

Some improvement has been obtained by the use of opposed cylinders which are in a straight line with one another and which include two pistons adapted to reciprocate toward and away from one another. Examples of this type of opposed cylinder engine are shown in U.S. Pat. Nos. 3,134,373 Which issued May 26, 1964, and 3,023,743, which issued Mar. 6, 1962.

SUMMARY OF THE INVENTION

The present invention contemplates the use of opposed cylinder configuration, but the opposed cylinders are angularly disposed with respect to one another in a V-shaped fashion. The combustion chamber is located between the two cylinders, and a crankshaft is located adjacent each of the opposite diverging ends of the cylinders. A second pair of identical cylinders may be connected to the same crankshafts in a symmetrical arrangement with the first mentioned pair of cylinders so that the four cylinders together form a rectangle having the two combustion chambers at two opposite corners of the rectangle and having the two crankshafts at the other two corners of the rectangle. Additional rectangular configurations may be mounted on the two crankshafts in side by side relationship with one another to provide as many cylinders are are desired.

This configuration provides considerable savings in space, engine weight, and efficiency. Furthermore, it contributes to the breathing of the engine and particularly to the scavenging cycle of the engine.

The incoming charge enters the cylinder pair at one end while exhausts leave at the other end for uniflow scavenging. In addition, more intake ports are located below the exhaust ports to provide loop scavenging. This multiple scavenging insures that each cylinder breathes all the air it needs to burn the fuel efficiently.

The present invention reduces fuel consumption compared to the conventional V-8 engine, and halves the space required for a two-cycle engine of any specified horsepower. This engine also reduces weight resulting from a smaller volume with lighter parts, and results in greater engine life because of low piston speed and operating pressures.

Instead of one power piston per cylinder, this engine has two (per cylinder pair). The combustion chamber surface area is a fraction of those in conventional engines. This means that less heat can be transferred from combustion to heat the cylinder. The engine runs cooler and produces less emissions.

Therefore, a primary object of the present invention is the provision of an engine which provides better breathing capabilities than previous devices.

A further object to the present invention is the provision of an engine which occupies less space and has a lighter weight than previous engines.

A further object of the present invention is the provision of an engine which burns fuel more completely and efficiently than in previous devices.

A further object of the present invention is the provision of an engine which operates at higher rotative speeds and lower temperatures than prior two-cycle engines of comparable displacement.

A further object of the present invention is the provision of an engine which more fully scavenges burned gases from the cylinder after the firing of the engine.

A further object of the present invention is the provision of an engine which charges the cylinder with more air prior to the firing of the engine.

A further object of the present invention is the provision of a device which provides more thorough mixture of the fuel and air within the combustion chamber.

A further object of the present invention is the provision of an engine which includes less combustion chamber surface area than in conventional engines so that less heat is transferred from the hot gases to heat the cylinder.

A further object of the present invention is the provision of an engine wherein the volume of trapped gas is greater than in previous devices thereby permitting more fuel to be burned so that increased output is obtained.

A further object to the present invention is the provision of a device wherein the port area available for fuel and air intake is increased.

A further object of the present invention is the provision of a device wherein the intake port area can be greater than the exhaust port area during the latter part of the scavenging cycle.

A further object of the present invention is the provision of an engine wherein the flow passages to and from the cylinder are short and streamlined.

A further object of the present invention is the provision of an engine which is easy and simple to manufacture and service.

This invention consists in the construction, arrangements and combination of the various parts of the device, whereby the objects contemplated are attained as hereinafter more fully set forth, specifically pointed out in the claims, and illustrated in the accompanying drawings in which:

Figure 1:
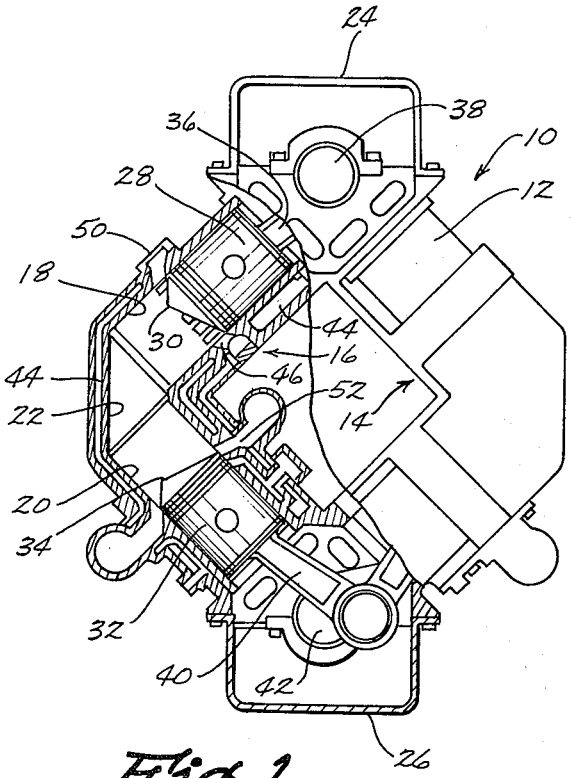
FIG. 1 is the front elevational view of the engine of the present invention having a portion of the housing broken away.
Figure 2:
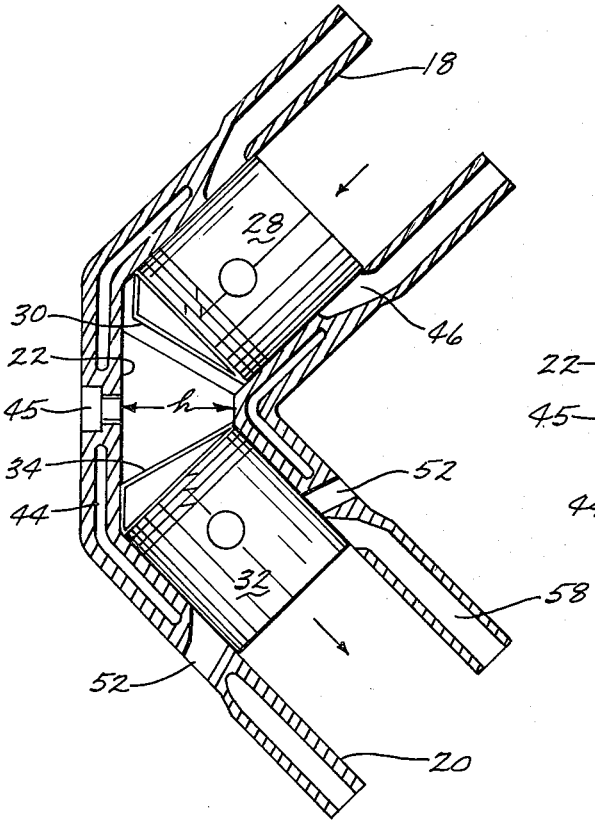
FIGS. 2, 3, 4, 5 and 6 are partial sectional views of the dual cylinder and piston configuration showing the relative positions of the two pistons during the fire, exhaust, multi-scavenge, uniflow scavenge, and recovery portions of the piston strokes.

Referring to FIG. 1, a two-cycle engine 10 is shown as having a housing 12 which is shaped to form two dual cylinders 14 and 16. Each dual cylinder includes an inlet cylinder 18 and a combination exhaust and inlet cylinder 20. The longitudinal axes of cylinders 18,

20 are angularly disposed with respect to one another so that cylinders 18, 20 are in a V-shaped configuration. At the apex of the V-shaped configuration is a combustion chamber 22. Referring to FIG. 2, the cross sectional height of combustion chamber 22 is represented by dimension line *h*, and this dimension is less than the diameter of cylinders 18 and 20. Because of this smaller dimension, gases passing from cylinder 18 to cylinder 20 are accelerated as they pass through combustion chamber 22, thereby contributing to the scavenging of combustion chamber 22 during the scavenging cycle which will be described hereinafter.

At the diverging ends of the V-shaped configuration formed by cylinders 18 and 20 are two crankcases 24 – 26. Slidably mounted within cylinder 18 is a piston 28 which is adapted to reciprocate upwardly and downwardly within cylinder 18. Piston 28 includes a beveled surface 30 which is presented toward combustion chamber 22 which is shaped to fit in mating engagement with the adjacent corners between cylinder 18 and combustion chamber 22. This mating engagement can be readily seen in FIG. 2. A second piston 32 is slidably mounted for reciprocating movement in cylinder 20 and includes a beveled surface 34 similar to beveled surface 30 of piston 28. Piston 28 is connected to a piston rod 36 which in turn is connected to a crankshaft 38 within housing 24 by means of a bearing means (not shown). Piston 32 is also connected to a piston rod 40 which in turn is connected to a crankshaft 42 within crankcase 26. Crankshafts 38 – 40 may also be connected to pistons within dual cylinder 14, but in view of the identical construction of cylinders 14 – 16, the details of dual cylinder 14 will not be described herein.

Housing 12 is shown to have a plurality of passageways 44 therein for conventional cooling systems used for internal combustion engines. It should be understood, however, that the present invention is equally applicable to air cooled engines or engines having other cooling systems.

Within combustion chamber 22 is an igniter or injector seat 45 which is shown only schematically in the drawings. A conventional spark plug may be seated in seat 45 or other ignition devices may be used. Also, the present invention may be applicable to diesel engines in which case a spark plug would not be used.

Figure 9:
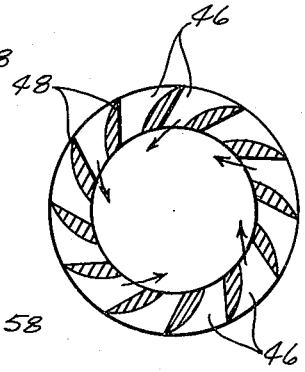
FIG. 9 is a sectional view taken along line 9 — 9 of FIG. 4.

A valve system is provided for cylinders 18 – 20 by plurality of ports which are in the cylinder walls of cylinders 18 – 20. Within cylinder 18 are a plurality of cirumferentially arranged inlet ports 46. These ports are separated by slanted and tapered vanes 48. Vanes 48 are slanted with respect to a radius of cylinder 18 so that they impart a swirling action to the air or fuel air mixture which enters cylinder 18 through inlet ports 46. The swirling action facilitates fuel mixture and also facilitates scavenging of burned out gases from combustion chamber 22. As can be seen in FIG. 9, ports 46 extend around 360° of cylinder 18. Inlet ports 46 are in communication with a circumferential inlet manifold 50 (FIG. 1) which can supply desired mixture of fuel and air. The particular mixture which is supplied through ports 46 may be varied according to the particular design needs of the particular engine being used.

Figure 7:
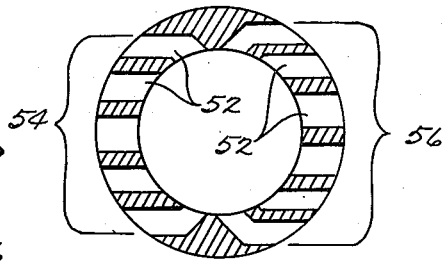
FIG. 7 is a sectional view taken along line 7 — 7 of FIG. 4.

Extending around the circumference of the exhaust cylinder 20 are a plurality of exhaust ports 52. Exhaust ports 52 are in two groups as illustrated in FIG. 7. One group is designated by the numeral 54 and extends only around a portion of the circumference of cylinder 20.

The other group is designated by the numeral 56 and extends around the remainder of the circumference of cylinder 20. The exhaust ports of group 54 are considerably longer than the exhaust ports of group 56 as can readily be seen in FIG. 4. Ports 52 are straight and are not tapered or slanted. This straight configuration permits the exit of gases from combustion 22 with a minimum of back pressure.

Figure 4:
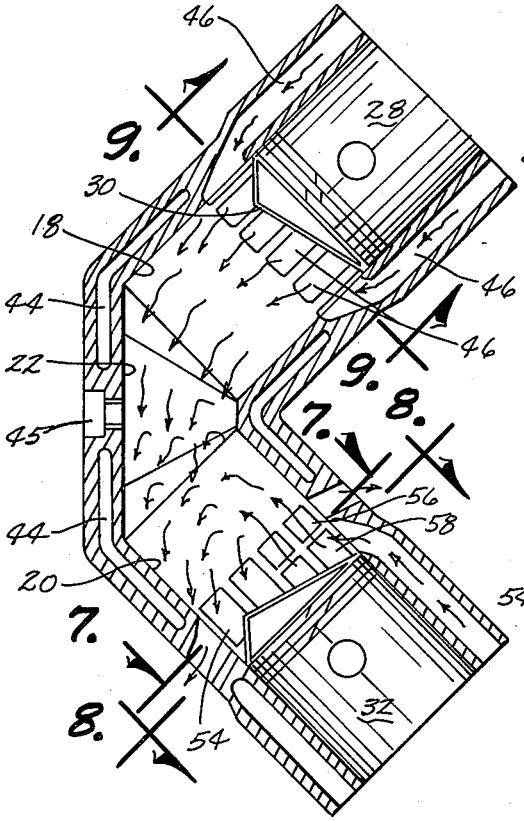
Figure 8:
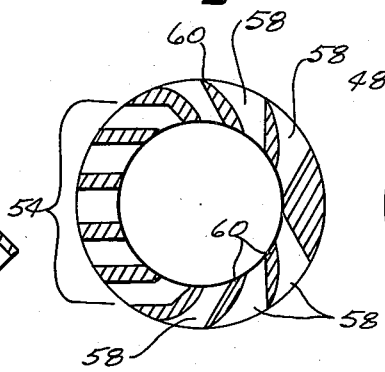
FIG. 8 is a sectional view taken along line 8 — 8 of FIG. 4.

Arranged below group 56 of exhaust ports 52 are a plurality of air inlet ports 58. Air inlet ports 58 are separated by a plurality of slanted and tapered vanes 60 which are shaped similarly to vanes 48 previously described, but are directed to promote loop scavenging flow. As can be seen in FIGS. 4, 7 and 8, air inlet ports 58 are arranged in complementary fashion with respect to groups 54 – 56 of exhaust ports 52. Thus, air inlet ports 48 are arranged directly below group 56 of exhaust ports 52. The percentage of the circumference which is occupied by air inlet ports 48 and group 56 of exhaust ports 52 may be varied according to design choice.

The operation of the present invention is shown in FIGS. 2 – 6 and FIG. 10. The power stroke of the cylinders is illustrated in FIG. 2. From FIG. 2 it can be seen that piston 32 leads piston 28 by a short increment. The positions of pistons 28 – 32 may be referenced by the degree turns in crankshafts 38 – 42, and using this reference means, piston 32 leads piston 28 by approximately 15°. Of course, the distance that piston 32 leads piston 28 may be varied according to design choice, as are all the dimensions of the components of the present invention. The firing within combustion chamber 22 takes place shortly before the pistons reach the position shown in FIG. 2. Normally, combustion takes place during the upstroke of piston 32. It will be noted that all cylinder ports 46, 52, and 58 are closed during this power portion of the stroke.

Figure 3:
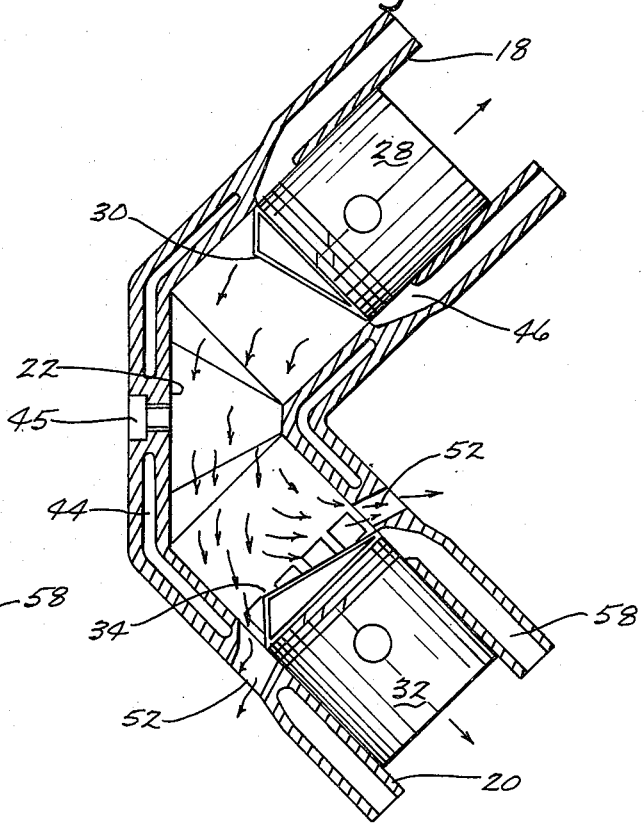

FIG. 3 illustrates the exhaust portion of the stroke. During the exhaust portion of the stroke, exhaust ports 52 are open, but fuel mixture inlet ports 46 and air inlet ports 58 are closed. The burned gases within chamber 22 and within the upper ends of cylinders 18, 20 are forced outwardly through exhaust ports 52 by virtue of the pressure within the cylinder.

FIG. 4 illustrates the multi-scavenging portion of the piston strokes. Piston 28 has progressed to the point where inlet ports 46 are open. Piston 32 has progressed to a position where both exhaust ports 52 and inlet ports 58 are open. Two types of scavenging, uniflow scavenging and loop scavenging, take place during this portion of the stroke Uniflow scavenging is provided by inlet ports 46 which are pressurized. The incoming charge enters the upper end of cylinder 18 from these ports and progresses through the throat of combustion chamber 22 into the upper end of exhaust cylinder 20. This flow serves to force out remaining burned gases which were in the chamber and causes the burned gases to exit through exhaust ports 52.

Loop scavenging is provided by air inlet ports 58 which are also pressurized As shown by the arrows in FIG. 4, the flow is introduced into the upper end of cylinder 20 through ports 58 and coacts with the flow of gases caused by uniflow scavenging from inlet ports 46. The swirling interaction of these two scavenging systems causes the burned gases within chamber 22 and within the upper ends of cylinders 18 – 20 to be more completely removed through exhaust ports 52 (which are in communication with the atmosphere) than in previous two-cycle engines.

Figure 5:
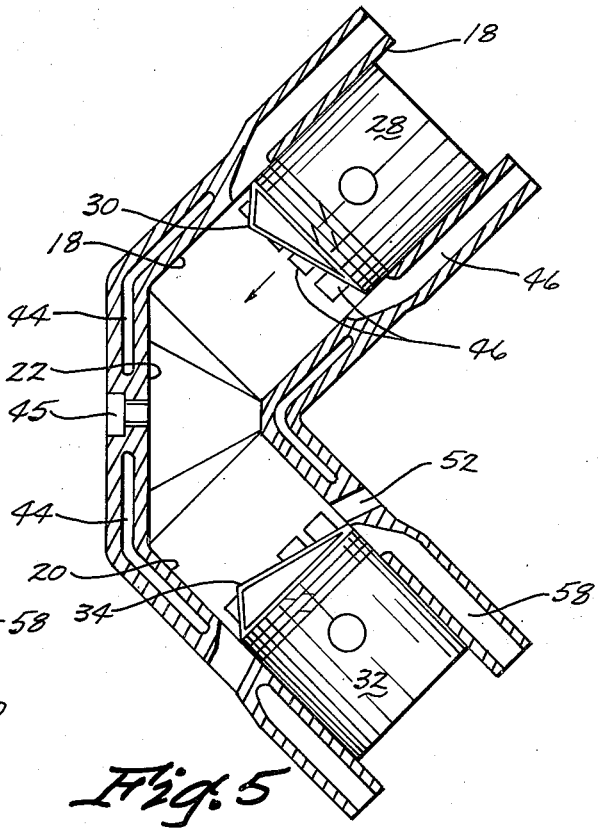

FIG 5 shows the single scavenging portion of the stroke wherein inlet ports 58 have been closed and inlet ports 48 remain open. This portion of the stroke permits inlet ports 46 to fully charge the cylinder while the last remaining burned gases are permitted to exit through exhaust ports 52.

Figure 6:
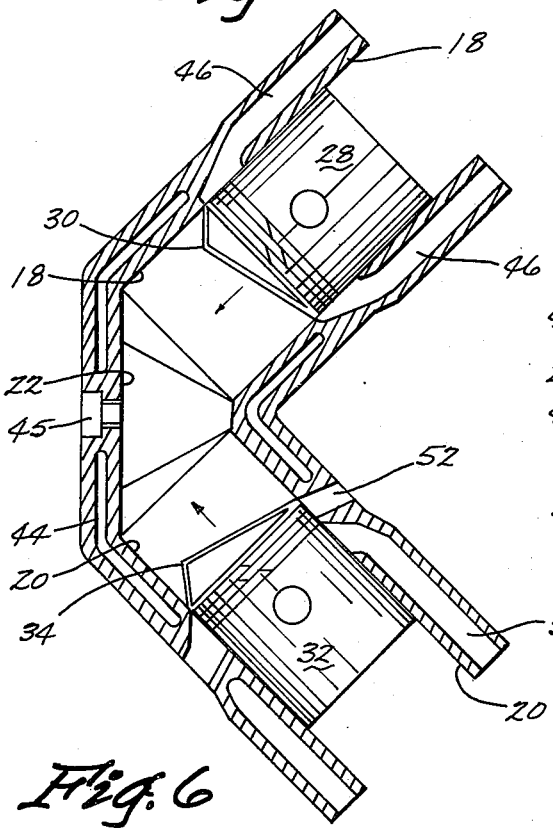

As pistons 28 – 52 continue upwardly they reach the position shown in FIG. 6 wherein all of ports 46, 52, and 58 are closed. Shortly after the cylinders reach this position the combustion chamber fires and the cycle is repeated.

Figure 10:
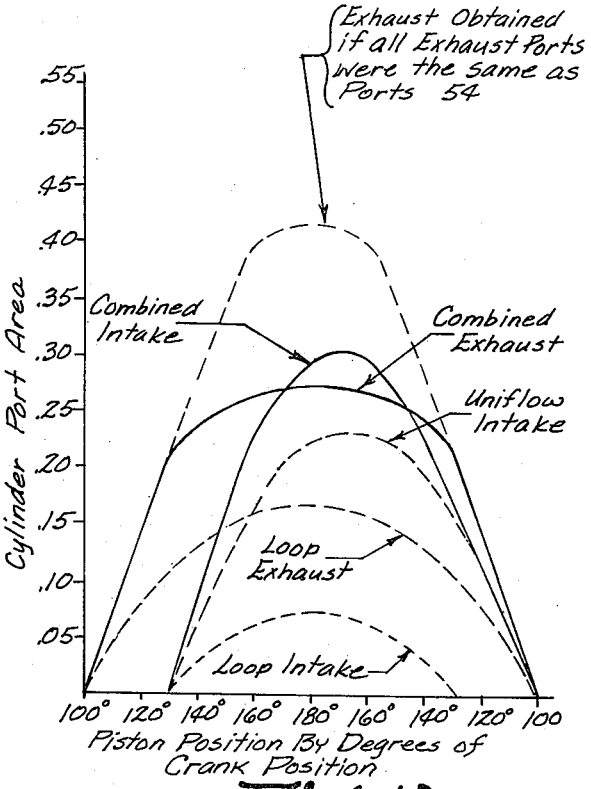
FIG. 10 is a graph showing typical cylinder port area which is open during the various positions of the piston. The piston's position is identified by the degrees of crank rotation.

The advantage which can be gained by the inlet and exhaust ports of the present invention are illustrated in FIG 10. The combined exhaust curve represents the combined exhaust port area of ports 54, 56 during the movement of the pistons from 100° to 180° to 100° as referenced by the position of the crankshaft. The combined intake curve represents the combined intake port area derived from inlet ports 46 – 58 during the cycle of the piston. The tallest curve represents the exhaust port area which would result if the exhaust ports were of uniform size such as shown by group 54 throughout 360° of the cylinder so that group 56 would be the same size as group 54.

The uniflow intake curve illustrates the port area provided by inlet ports 46. The loop intake curve illustrates port area provided by air inlet ports 58. Referring to FIG. 10, it can be seen that the combined inlet port area represented by the combined intake curve is considerably greater than the uniflow inlet port area (uniflow intake curve) which is found in presently existing opposed cylinder engines. Also, a comparison of the combined exhaust and combined intake curves reveals that the combined exhaust area of ports 54, 56 is less than the combined inlet area of ports 46, 58 during at least a portion of the cycle. This is a phenomenon which does not normally occur in presently existing engines. Since the area of the inlet ports is at times greater in relationship with the exhaust port area, the inlet ports 46 – 58 increase the pressure within chamber 22 at a greater rate than the pressure is relieved by exhaust ports 52. This relative pressure is important to charging the chamber before port closure also in facilitating the scavenging cycle.

Several advantages are derived from the present invention. The combustion chamber surface area is substantially less than that of conventional devices, thereby reducing heat loss so that the engine will run more efficiently.

The shape of the combustion chamber enhances combustion and gas flow, thereby reducing energy losses during the cycle.

The multi-scavenging provided by ports 46 and 58 permits both uniflow and loop scavenging so that the two scavenging methods complement one another and reduce the scavenging path length. This facilitates cleaning and filling the cylinder in a manner superior to that of presently existing devices.

The trapped volume within the cylinder when all ports are closed is greater than in most designs. This greater volume elevates the amount of fuel that can be burned efficiently so that increased horsepower output is obtained.

The effective power stroke is greater than in most designs, thereby increasing the output that can be obtained and improving efficiency.

The inlet cylinder port areas are greater than presently existing designs thereby minimizing flow losses to and from the cylinder.

The rate at which the cylinder port area increases during the cycle is greater than presently known designs, thereby decreasing the exhaust blowdown period and increasing the intake period.

Less fuel mixture is lost through the exhaust ports, thereby improving efficiency and reducing pollution.

The intake port area is greater than the exhaust port area during the latter part of the scavenging cycle. This assures that the cylinder pressure is equal to or greater than the intake pressure.

The air intake port area is several times greater than the air inlet port area of conventional devices.

The flow passages to and from the cylinder are short and streamlined.

The device is adaptable to supercharging for elevating the air intake pressure.

The geometry of the design permits cylinders to be combined in a much smaller package than in previous prior art devices. For example, two rectangular arrangements such as shown in FIG. 1 may be placed in side by side relationship to provide an eight-cylinder engine. Such an engine would have one-half the length of the presently existing V-8 engines. The advantage to be obtained by the reduced weight and reduced size of the present invention include far more efficient operation and far more space available for anti-pollution equipment.

Thus it can be seen that the device accomplishes at least all of the stated objectives.

DESCRIPTION OF THE PREFERRED EMBODIMENT

The preferred embodiment of the present invention includes the V-8 shape cylinder arrangement having the inlet ports 46, exhaust ports 52 in two groups 54, 56, and inlet ports 58. It is also preferred that the cylinders be arranged in angular relationship.

A modification of the present invention may include a similar configuration, but with air inlet ports omitted so that exhaust ports 52 are uniform and are similar to group 54 thereof.

A further embodiment of the present invention may be the use of the port system such as shown in the drawings, but with the cylinders arranged in a directly opposite or straight line configuration. While the straight line opposed cylinder configuration would be less desirable than the V configuration shown in the drawings, it still would be superior to present opposed cylinder engines because it would provide the multi-scavenging advantage by virtue of ports 46 and 58.

I claim:

1. Internal combustion engine comprising:

a housing having first and second cylinders, a combustion chamber, and two crankcases, said cylinders each having first ends positioned adjacent one another, and second ends positioned adjacent one of said crankcases, said combustion chamber being between said first ends of said cylinders;

first and second pistons slidably mounted in said first and second cylinders respectively for reciprocating movement therein;

crankshaft means within said crankcases;

means interconnecting said pistons with said crankshaft means for transferring said reciprocating movement of said pistons into rotational movement of said crankshaft means;

first inlet ports arranged in a full circular array around the circumference of said first cylinder for charging said first cylinder whenever said first piston is in a predetermined position;

exhaust ports in said second cylinder for venting said second cylinder and said combustion chamber to the atmosphere whenever said second piston is in a predetermined position within said second cylinder;

second inlet ports in said second cylinder for charging and scavenging said second cylinder while said exhaust ports are open;

said exhaust ports being arranged in a full circular array around the circumference of said second cylinder;

said second inlet ports being in at least a partial circular array around the circumference of said second cylinder;

said exhaust ports being positioned so as to be open whenever said second inlet ports are open;

the relative port areas of said exhaust ports, said first inlet ports, and said second inlet ports being such that the total inlet port area exceeds the total exhaust port area during at least a portion of the cycle of said pistons.

2. An internal combustion engine according to claim 1 wherein said housing includes two additional V-shaped cylinders and an additional combustion chamber at the apex of said V-shaped configuration; third and fourth pistons being mounted within said two additional cylinders; piston rods connecting said third and fourth pistons to said crankshafts, whereby said four cylinders form a diamond shaped configuration with said crankshafts at two opposite apexes of said diamond configuration and with said two combustion chambers at the remaining two apexes of said diamond configuration.

3. An internal combustion engine according to claim 1 wherein said first and second pistons are each movable through a reciprocating stroke having power, exhaust, and scavenging portions, said first and second inlet ports and said exhaust ports being closed during said power portion of said stroke, said exhaust ports being open and said first and second inlet ports being closed during said exhaust portion of said stroke; and said first and second inlet ports and said exhaust ports being open during said scavenging portion of said stroke.

4. Internal combustion engine comprising:

a housing having first and second cylinders, a combustion chamber, and two crankcases, said cylinders each having first ends positioned adjacent one another, and second ends positioned adjacent one of said crankcases, said combustion chamber being between said first ends of said cylinders;

first and second pistons slidably mounted in said first and second cylinders respectively for reciprocating movement therein;

crankshaft means within said crankcases;

means interconnecting said pistons with said crankshaft means for transferring said reciprocating movement of said pistons into rotational movement of said crankshaft means;

first inlet ports arranged in a full circular array around the circumference of said first cylinder for charging said first cylinder whenever said first piston is in a predetermined position;

exhaust ports in said second cylinder for venting said second cylinder and said combustion chamber to the atmosphere whenever said second piston is in a predetermined position within said second cylinder;

second inlet ports in said second cylinder for charging and scavenging said second cylinder while said exhaust ports are open;

said exhaust ports being arranged in a full circular array around the circumference of said second cylinder;

said second inlet ports being in at least a partial circular array around the circumference of said second cylinder; said second inlet ports being positioned further from said combustion chamber than said exhaust ports throughout the array of said second inlet ports;

said exhaust ports being positioned so as to be open whenever said second inlet ports are open.

* * * * *